United States Patent [19]

Andou et al.

[11] Patent Number: 5,017,029

[45] Date of Patent: May 21, 1991

[54] CORROSION SUPPRESSING INK RIBBON

[75] Inventors: Hirokazu Andou; Hiroshi Kikuchi; Hiroki Murakawa, all of Tokyo, Japan

[73] Assignee: Oki Electric Industry Co., Ltd., Tokyo, Japan

[21] Appl. No.: 361,166

[22] Filed: Jun. 5, 1989

[30] Foreign Application Priority Data

Jun. 6, 1988 [JP] Japan ..... 63-137376
Jun. 6, 1988 [JP] Japan ..... 63-137377

[51] Int. Cl.[5] ..... B41J 31/00
[52] U.S. Cl. ..... 400/237; 400/241
[58] Field of Search ..... 400/124, 240, 240.1, 400/240.3, 240.4, 241, 241.1, 241.2, 701, 702, 702.1, 237; 8/657; 428/413, 913, 914; 430/182; 503/210

[56] References Cited

U.S. PATENT DOCUMENTS

| | | | |
|---|---|---|---|
| 3,392,042 | 7/1968 | Findlay et al. | 400/241.2 X |
| 3,825,470 | 7/1974 | Elbert et al. | 400/241.1 X |
| 3,912,831 | 10/1975 | Kan et al. | 503/210 X |
| 3,976,488 | 8/1976 | Nihyakumen et al. | 430/182 X |
| 4,137,042 | 1/1979 | Defago et al. | 8/657 X |
| 4,477,198 | 10/1984 | Bowlds et al. | 400/241.1 X |
| 4,541,340 | 9/1985 | Pert et al. | 400/241.1 X |
| 4,610,554 | 9/1986 | Suzuki et al. | 400/124 |
| 4,678,701 | 7/1987 | Pennington et al. | 400/241.1 X |
| 4,840,848 | 6/1989 | Koshizuka et al. | 428/413 |
| 4,867,583 | 9/1989 | Caulier et al. | 400/124 |

FOREIGN PATENT DOCUMENTS

| | | | |
|---|---|---|---|
| 0130218 | 10/1979 | Japan | 400/241.1 |
| 59-79766 | 5/1984 | Japan . | |
| 0079788 | 5/1984 | Japan | 400/241.1 |

OTHER PUBLICATIONS

Itoh, Hisayasu, "A Study of Magnetic Characteristics and Minimum Equivalent Mass of Armatures in Wire Matrix Print-Head", Technical Paper of Electronics and Communications Engineers of Japan, EMC84-2, pp. 9-16.

*Primary Examiner*—Edgar S. Burr
*Assistant Examiner*—C. Bennett
*Attorney, Agent, or Firm*—Panitch, Schwarze, Jacobs & Nadel

[57] ABSTRACT

Ink in an ink ribbon contains per 100 parts by weight of ink, 0.1-10 parts by weight of an adsorption-type corrosion suppressor. The adsorption-type corrosion suppressor may be one or more of, the following compounds: amines of the formula R—$NH_2$, RR'—NH, RR'R''—N (where R, R' and RR'' are alkyl groups), thiourea and its derivatives, benzotriazole and its derivatives, thiazole, thioamides and thiosemicarbazide. In another aspect of the invention, the ink contains an organic pigment as coloring material, said ink containing 5.0-10.0 parts by weight of graphite per 100 parts by weight of ink.

2 Claims, 6 Drawing Sheets

CORROSION SUPPRESSING INK RIBBON

BACKGROUND OF THE INVENTION

This invention concerns ink ribbons.

In recent years, impact printers with cost advantages which are capable of high speed printing are finding wide application as man-machine interfaces, for example as peripheral terminal units in data processing systems.

Impact printers which print at high speeds constantly have to deal with a large volume of data, and so it is important that they have reliable print heads. It is moreover highly desirable that print wires operate stably over long periods without suffering corrosion or wear, and without damaging the ink ribbon. These print wires may be made of super-hard or other wear-resistant alloy or of ferrous material which is easy to process and is inexpensive (Patent Application Kokai Publication No. 59-79766).

However, even these wires suffered from the major drawback that when they were used over long periods, the metal constituents of the wire were sometimes chemically corroded.

The corrosion of the wires however also depends on the components of the ink in the ribbon.

The black ink used in conventional ribbons may contain carbon black as coloring material, as disclosed in Patent Application Publication No. 57-60956, and is in fact a mixture of vegetable oil and mineral oil vehicles, carbon black and oil-soluble dyes as coloring materials, and other components such as dispersing agents.

Carbon black normally contains 2–5 weight % ash as impurities, together with sulfur oxides and chloride ions. In the presence of moisture and oxygen in the atmosphere, these impurities cause chemical corrosion of the metal components of the print wire surface, and lead to serious damage such as wire tip wear and wire breakage.

In order to solve these problems, carbon black containing no more than 1% of impurities was used, or the impurities in the carbon black were eliminated in the process of manufacture of the ink ribbon. Pure carbon black is however very costly. Moreover, the elimination of impurities during manufacture of the ink ribbon led to an increase in the number of manufacturing steps, and so the cost of manufacturing the ribbon was again increased.

Another critical factor in high speed printing is that the print head and other moving parts should be lightweight, as is disclosed in for example the Technical Paper of the Institute of Electronics and Communications Engineers of Japan EMC84-2, pp. 9–16. The print wires of super-hard alloy mentioned above contain about 70–85 parts by weight of tungsten carbide, and their density attains 13.5–14.5 g/cm$^3$. It is thus difficult to make these wires lightweight.

To realize high speed printing, therefore, ordinary ferrous printing wires with a density of approximately 8 g/cm$^3$ have to be used. These ferrous wires are however not so reliable, as they easily wear down and the life of the print head is short.

The wearing of the print wires is actually a mechanical abrasion due to the ink ribbon. For example, the carbon black contained in the black ink in the conventional ribbons, as is disclosed in the above-mentioned Japanese Patent Application Publication No. 57-60956 has the same effect as minute particles of polishing powder, and in effect causes mechanical wear or "abrasion" of the print wire surface layer.

Instead of carbon black, some ribbon inks use organic pigments to avoid this abrasive wear. However, the print density with respect to near infra-red radiation (wavelength 780–1500 nm) of a print sample produced by these inks, is weaker than that of a sample produced by inks containing carbon black, and problems therefore occurred due to errors when reading the print with an OCR (optical character reader). The life of the ink ribbon was naturally shorter, and the greater length of ribbon necessary to compensate for it led to higher cost. In addition, the printer ribbon cartridge was larger, so that the printer as a whole had to be made bigger.

SUMMARY OF THE INVENTION

This invention aims to solve the disadvantage of serious corrosion of print wires, and to provide an ink ribbon at low cost.

Another object of the invention is to provide an ink ribbon without the disadvantage of lower print density in the near infra-red region.

According to a first aspect of the invention, the ink in the ink ribbon contains per 100 parts by weight of ink, 0.1–10 parts by weight of one or more of the following compounds: amines denoted by the formula R—$NH_2$, RR′—NH, RR′R″—N (where R, R′ and R″ are alkyl groups), thiourea and its derivatives, benzotriazole and its derivatives, thiazole, thioamides and thiosemicarbazide.

In the first aspect of the invention, the adsorption-type corrosion suppressors added to said ink (referred to hereafter also as additives), are physically or chemically adsorbed on the metal surface of the print wire that undergoes corrosion, thereby greatly reducing the surface area promoting the corrosion reaction, and vastly reducing wire breakages and the like due to corrosion.

According to the second aspect of the invention, an ink ribbon is made of a ribbon substrate and an ink which has an organic pigment as coloring material, said ink containing 5.0–10 parts by weight of graphite per 100 parts by weight of ink.

In the third aspect of the invention, the ink ribbon contains an ink with an organic pigment to which graphite, normally used as a solid lubricant, is added to reduce wear by virtue of its lubricating action, and to offset the loss of print density.

DETAILED DESCRIPTION OF THE EMBODIMENTS

Figure 1:
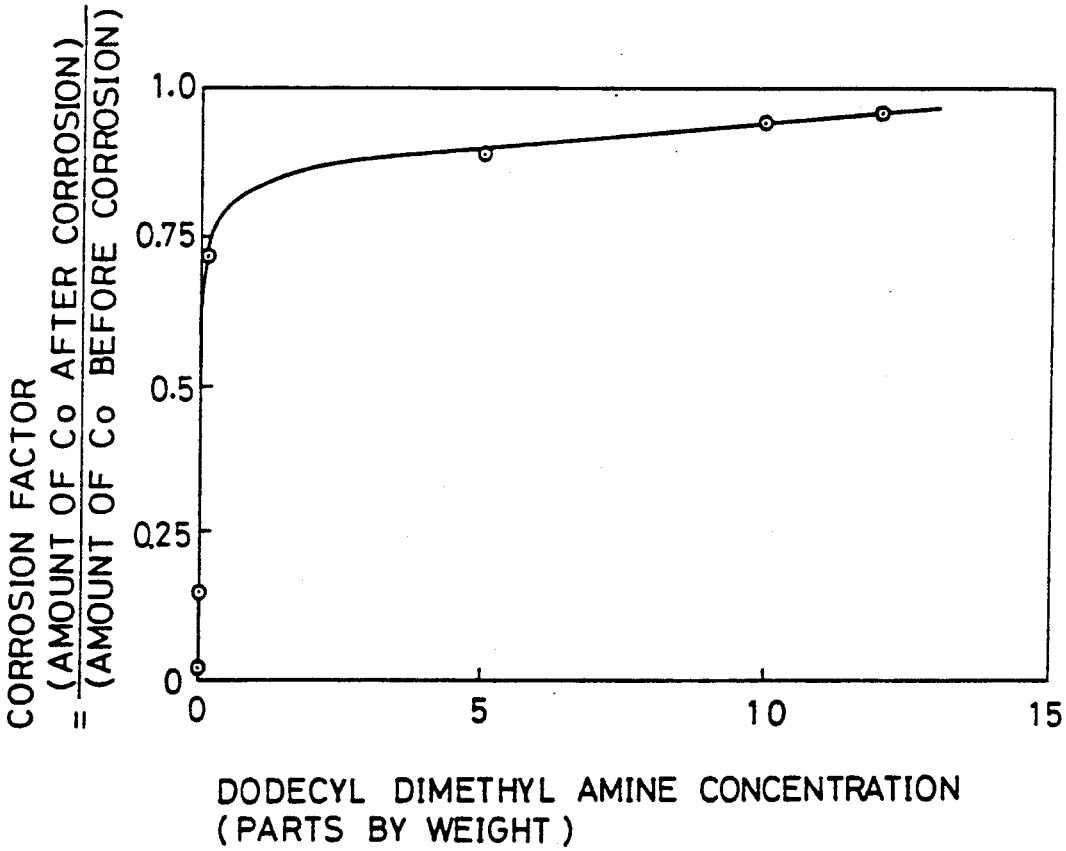
FIG. 1 is a graph of corrosion factor versus dodecyl dimethylamine concentration.

The invention will now be described in more detail with reference to specific embodiments. Parts specified below are parts by weight.

Embodiments and Comparative Examples in the first aspect of the invention will first be described.

COMPARATIVE EXAMPLE A1

A ribbon ink was manufactured from 30 parts vegetable oil and 30 parts mineral oil as vehicles, 15 parts carbon black and 15 parts oil-soluble dyes as coloring materials, and 10 parts sorbitan fatty acid ester as dispersing agent as shown in the Table 1 given below. These components were premixed in a mixer, and then uniformly mixed by 3 rolls. The ink ribbon tissue was a polyamide fiber such as Nylon 6 or Nylon 66, or a polyester fiber, fashioned into an endless ribbon in the shape of a Möbius band of length 50 m, width 13 mm and thickness 0.12 mm. Each of these ribbons was uniformly coated and impregnated with 12 g of the ribbon ink described above. The ink ribbon obtained was then loaded into an impact printer together with a print head using print wires of wear-resistant alloy, and the printer was operated. The printer operating conditions were strike pressure 14 kg/mm$^2$, print speed 180 strikes/sec, and ink ribbon feed speed 30 mm/sec. After each wire had been allowed to strike 15 million times, the wires were left in the atmosphere at room temperature with the ribbon ink still adhering to them for a period of 1 week.

The extent of corrosion was found by SEM (scanning electron microscopy) using an electron microscope. A cobalt analysis was performed on the wires before printing and 1 week after printing, and respective cobalt ratios were calculated. This ratio will be referred to as the corrosion factor represented by the expression: (Co after corrosion)/(Co before corrosion).

The surface condition of the print wires was also inspected using the electron microscope. As a result, the corrosion factor was 0.02, and the surface was found to have multiple cobalt corrosion 103 as shown schematically in FIG. 2 and FIG. 3.

Figure 2:
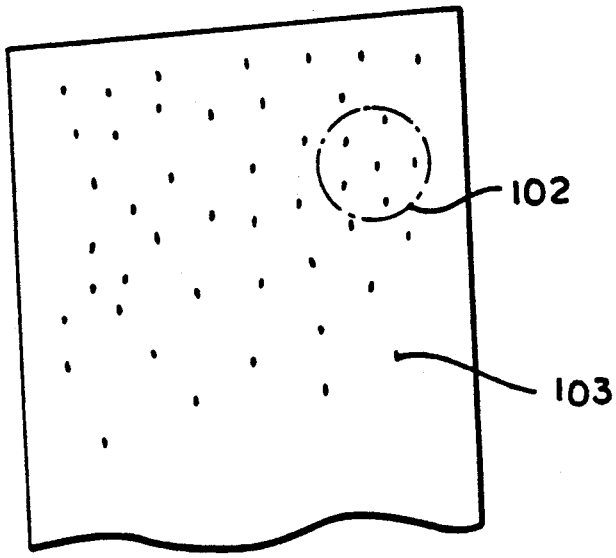
FIG. 2 is a drawing of print wire corrosion.
Figure 3:
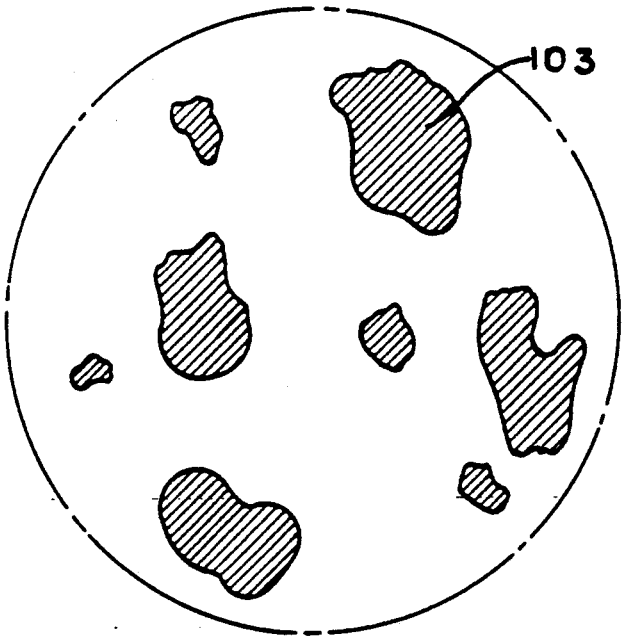
FIG. 3 is an enlarged view of the same part of the wire.

For the purpose of clarity, region 102, shown in FIG. 2, is enlarged in FIG. 3. Further, when the printer was made to give another 15 million strikes using this print head, several wires broke where they were corroded, and some print pixels were missing.

COMPARATIVE EXAMPLE A2

An ink was obtained as in Comparative Example A1 by mixing 31 parts vegetable oil, 28.99 parts mineral oil, 15 parts carbon black, 15 parts oil-soluble dye, 10 parts sorbitan fatty acid ester, and 0.01 parts dodecyl dimethylamine which is a type of amine, as the additive. This ink was used to manufacture an ink ribbon. The ribbon was loaded into a printer, and operated to carry out the test described in Comparative Example A1. As a result, the corrosion factor was 0.15. When printing was continued under the same conditions, several wires broke where they were corroded so that some print pixels were missing.

EMBODIMENT A1

An ink was obtained as in Comparative Example A1 by mixing 31 parts vegetable oil, 28.9 parts mineral oil, 15 parts carbon black, 15 parts oil-soluble dye, 10 parts sorbitan fatty acid ester, and 0.1 parts dodecyl dimethylamine as the additive. This ink was used to manufacture an ink ribbon. The ribbon was loaded into a printer, and operated to carry out the test described in Comparative Example A1. As a result, the corrosion factor was 0.72, i.e. close to 1. Inspection with the electron microscope also showed a satisfactory surface with almost no corrosion. Printing was then continued under the same conditions. There were no wire breakages, and no missing print pixels were found. Further, there was practically no deterioration of print quality with regard to both clarity and hue.

EMBODIMENT A2

An ink was obtained as in Comparative Example A1 by mixing 30 parts vegetable oil, 25 parts mineral oil, 15 parts carbon black, 15 parts oil-soluble dye, 10 parts sorbitan fatty acid ester, and 5 parts dodecyl dimethylamine as the additive. This ink was used to manufacture an ink ribbon. The ribbon was loaded into a printer, and operated to carry out the test described in Comparative Example A1. As a result, the corrosion factor was 0.89, i.e. even closer to 1. Surface inspection with the electron microscope showed almost no corrosion. Printing was then continued under the same conditions. There were no wire breakages, and no missing print pixels were found.

Instead of said dodecyl dimethylamine, one or more of the following compounds were used: dodecyl amine and oleil amine, which are primary amines, dioleil amine which is a secondary amine, and octadecyl methylamine which is a tertiary amine. Practically the same results were obtained.

EMBODIMENT A3

An ink was obtained as in Comparative Example A1 by mixing 25 parts vegetable oil, 25 parts mineral oil, 15 parts carbon black, 15 parts oil-soluble dye, 10 parts sorbitan fatty acid ester, and 10 parts dodecyl dimethylamine as the additive. This ink was used to manufacture an ink ribbon. The ribbon was loaded into a printer, and operated to carry out the test described in Comparative Example A1. As a result, the corrosion factor was 0.94. Surface inspection with the electron microscope also showed almost no corrosion. Printing was then continued under the same conditions. There were no wire breakages, and no missing print pixels were found. Further, there was practically no deterioration of print quality with regard to both clarity and hue.

EMBODIMENT A4

Apart from the use of 13 parts oil-soluble dye and 12 parts dodecyl dimethylamine, the procedure was the same as in Embodiment A3. The corrosion factor was found to be 0.95, and surface inspection with the electron microscope showed almost no corrosion. There were no wire breakages, and no missing print pixels were found. Further, there was no deterioration of print quality with regard to both clarity and hue.

FIG. 1 is a graphical representation of corrosion factor plotted against concentration of dodecyl dimethylamine, based on the results of Comparative Example A1-Embodiment A4. It is seen from this figure that as more dodecyl amine is added, the corrosion factor of the print wire increases together with its concentration tending rapidly towards 1. Above 10 parts of additive, however, there was little further increase of the corrosion factor.

EMBODIMENT A5

The dodecyl dimethylamine in Embodiment A2 was replaced by 5 parts of thiourea, otherwise the procedure was exactly the same. The corrosion factor was found to be 0.82, and surface inspection with the electron microscope also showed almost no corrosion. Further, there was no deterioration of print quality with regard to both clarity and hue. The same test was repeated with thiourea derivatives instead of thiourea, and similar results were obtained.

EMBODIMENT A6

The dodecyl dimethylamine in Embodiment A2 was replaced by 5 parts of benzotriazole, otherwise the procedure was exactly the same. The corrosion factor was found to be 0.87, and surface inspection with the electron microscope also showed almost no corrosion. Further, there was no deterioration of print quality with regard to both clarity and hue. The same test was repeated with benzotriazole derivatives instead of benzotriazole, and similar results were obtained.

EMBODIMENT A7

The dodecyl dimethylamine in Embodiment A2 was replaced by 5 parts of thiazole, otherwise the procedure was exactly the same. The corrosion factor was found to be 0.86, and surface inspection with the electron microscope showed almost no corrosion. Further, there was no deterioration of print quality with regard to both clarity and hue.

EMBODIMENT A8

The dodecyl dimethylamine in Embodiment A2 was replaced by 5 parts of thioamides, otherwise the procedure was exactly the same. The corrosion factor was found to be 0.79, and surface inspection with the electron microscope showed almost no corrosion. Further, there was no deterioration of print quality with regard to both clarity and hue.

EMBODIMENT A9

The dodecyl dimethylamine in Embodiment A2 was replaced by 5 parts of thiosemicarbazide, otherwise the procedure was exactly the same as in Embodiment A2. The corrosion factor was found to be 0.81, and surface inspection with the electron microscope showed almost no corrosion. Further, there was no deterioration of print quality with regard to both clarity and hue.

From the above description and the results of the above table, it is clear that if dodecyl dimethylamine is replaced by thiourea or its derivatives, benzotriazole or its derivatives, thiazole, thioamides or thiosemicarbazide, there is some divergence of results, but the corrosion factor is still close to 1 and satisfactory.

TABLE 1

| | Carrier | | Coloring Material | | Dispersion Agent | | Additive | | Corrosion Factor | Print Quality |
|---|---|---|---|---|---|---|---|---|---|---|
| Comparative Test | | | | | | | | | | |
| 1 | Vegetable Oil | 30 | Carbon Black | 15 | Sorbitan Fatty | 10 | None | | 0.02 | Print Miss |
| | Mineral Oil | 30 | Oil-soluble Dye | 15 | Acid Ester | | | | | |
| 2 | Vegetable Oil | 31 | Carbon Black | 15 | Sorbitan Fatty | 10 | Dodecyl- | 0.01 | 0.15 | " |
| | Mineral Oil | 28.99 | Oil-soluble Dye | 15 | Acid Ester | | dimethylamine | | | |
| Embodiment | | | | | | | | | | |
| 1 | Vegetable Oil | 31 | Carbon Black | 15 | Sorbitan Fatty | 10 | Dodecyl- | 0.1 | 0.72 | No |
| | Mineral Oil | 28.9 | Oil-soluble Dye | 13 | Acid Ester | | dimethylamine | | | Deterioration |
| 2 | Vegetable Oil | 30 | Carbon Black | 15 | Sorbitan Fatty | 10 | Dodecyl- | 5 | 0.89 | No |
| | Mineral Oil | 25 | Oil-soluble Dye | 15 | Acid Ester | | dimethylamine | | | Deterioration |
| 3 | Vegetable Oil | 25 | Carbon Black | 15 | Sorbitan Fatty | 10 | Dodecyl- | 10 | 0.94 | No |
| | Mineral Oil | 25 | Oil-soluble Dye | 15 | Acid Ester | | dimethylamine | | | Deterioration |
| 4 | Vegetable Oil | 25 | Carbon Black | 15 | Sorbitan Fatty | 10 | Dodecyl- | 12 | 0.95 | No |
| | Mineral Oil | 25 | Oil-soluble Dye | 15 | Acid Ester | | dimethylamine | | | Deterioration |
| 5 | Vegetable Oil | 30 | Carbon Black | 15 | Sorbitan Fatty | 10 | Thiourea | 5 | 0.82 | No |
| | Mineral Oil | 25 | Oil-soluble Dye | 15 | Acid Ester | | | | | Deterioration |
| 6 | Vegetable Oil | 30 | Carbon Black | 15 | Sorbitan Fatty | 10 | Benzotriazole | 5 | 0.87 | No |
| | Mineral Oil | 25 | Oil-soluble Dye | 15 | Acid Ester | | | | | Deterioration |
| 7 | Vegetable Oil | 30 | Carbon Black | 15 | Sorbitan Fatty | 10 | Thiazole | 5 | 0.86 | No |
| | Mineral Oil | 25 | Oil-soluble Dye | 15 | Acid Ester | | | | | Deterioration |
| 8 | Vegetable Oil | 30 | Carbon Black | 15 | Sorbitan Fatty | 10 | Thioamides | 5 | 0.79 | No |
| | Mineral Oil | 25 | Oil-soluble Dye | 15 | Acid Ester | | | | | Deterioration |
| 9 | Vegetable Oil | 30 | Carbon Black | 15 | Sorbitan Fatty | 10 | Thiosemicarbazide | 5 | 0.81 | No |
| | Mineral Oil | 25 | Oil-soluble Dye | 15 | Acid Ester | | | | | Deterioration |

(Units are Parts by Weight)

EMBODIMENT A10

The 5 parts of additive in the above Embodiments A5–A9 were each reduced by 0.1 part, and the same procedure was carried out as in Embodiment A1. As a result, the corrosion factor was almost the same as in Embodiment A1. Surface inspection with the electron microscope revealed a very small amount of corrosion, however no wire breakages occurred in subsequent printing and no missing print pixels were found.

EMBODIMENT A11

5 parts of thiourea were added to 5 parts of dodecyl dimethylamine, otherwise the procedure was exactly the same as in Embodiment A2. The corrosion factor was found to be 0.94, and surface inspection with the electron microscope showed almost no corrosion. Further, there was no deterioration of print quality with regard to both clarity and hue.

Further, when two or more of the above additives were used, the corrosion of the print wires was still reduced and a satisfactory result was still obtained without any deterioration of print quality.

In the above description, the various additives given as examples are generally referred to as adsorption-type corrosion suppressors. It will of course be evident that similar results will be obtained if other adsorption-type corrosion suppressors are used.

According to the embodiments A1to A11 described above, the admixture of adsorption-type corrosion suppressors such as amines, thiourea or its derivatives, benzotriazole or its derivatives, thiazole, thioamides or thiosemicarbazides with ribbon ink, greatly reduces print wire corrosion resulting from the ink, extends the life of print heads, and increases reliability. The material cost of the ribbon is also decreased, print misses are eliminated, and print quality is very much improved.

Embodiments and Comparative Examples in the second aspect of the invention will now be described.

COMPARATIVE EXAMPLE B1

A ribbon ink was manufactured from 30 parts vegetable oil and 30 parts mineral oil as vehicles, 15 parts of a condensed polycylic organic pigment (Pariogen Black K0084, manufactured by BASF Inc. ) and 15 parts of an oil-soluble dye as coloring materials, and 10 parts sorbitan fatty acid ester as dispersion agent as shown in the Table 2 given below.

These components were premixed in a mixer, and then uniformly mixed by 3 rolls. The ink ribbon tissue was a polyamide fiber such as Nylon 6 or Nylon 66, or a polyester fiber, fashioned into an endless ribbon in the shape of a Möbius band of length 50 m, width 13 mm and thickness 0.12 mm. Each of these ribbons was uniformly coated and impregnated with 12 g of the ribbon ink described above. The ink ribbon obtained was then loaded into an impact printer together with a print head using ferrous print wires, and the printer was operated. The printer operating conditions were strike pressure 14 $kg/mm^2$, print speed 180 strikes/sec, and ink ribbon feed speed 30 mm/sec. After each wire had been allowed to strike 20 million times, the ink ribbon was changed so as to keep ink consumption constant.

The dependence of print density (PCS value) on the number of print strikes was investigated each time the ink ribbon has been struck 2 million times by the print wires. Print density was measured by a PCM-II Print Density Meter manufacture by Macbeth Ltd., and the PCS value was calculated using a B filter (for optical character recognition). A PCS value of 1.0 corresponded to pure black, and 0.0 to pure white. It is known that with an OCR device which operates at a wavelength of 950 nm, errors occurred at a PCS value of 0.3 or less, so this value was taken to indicate the life of the ribbon.

Figure 5:
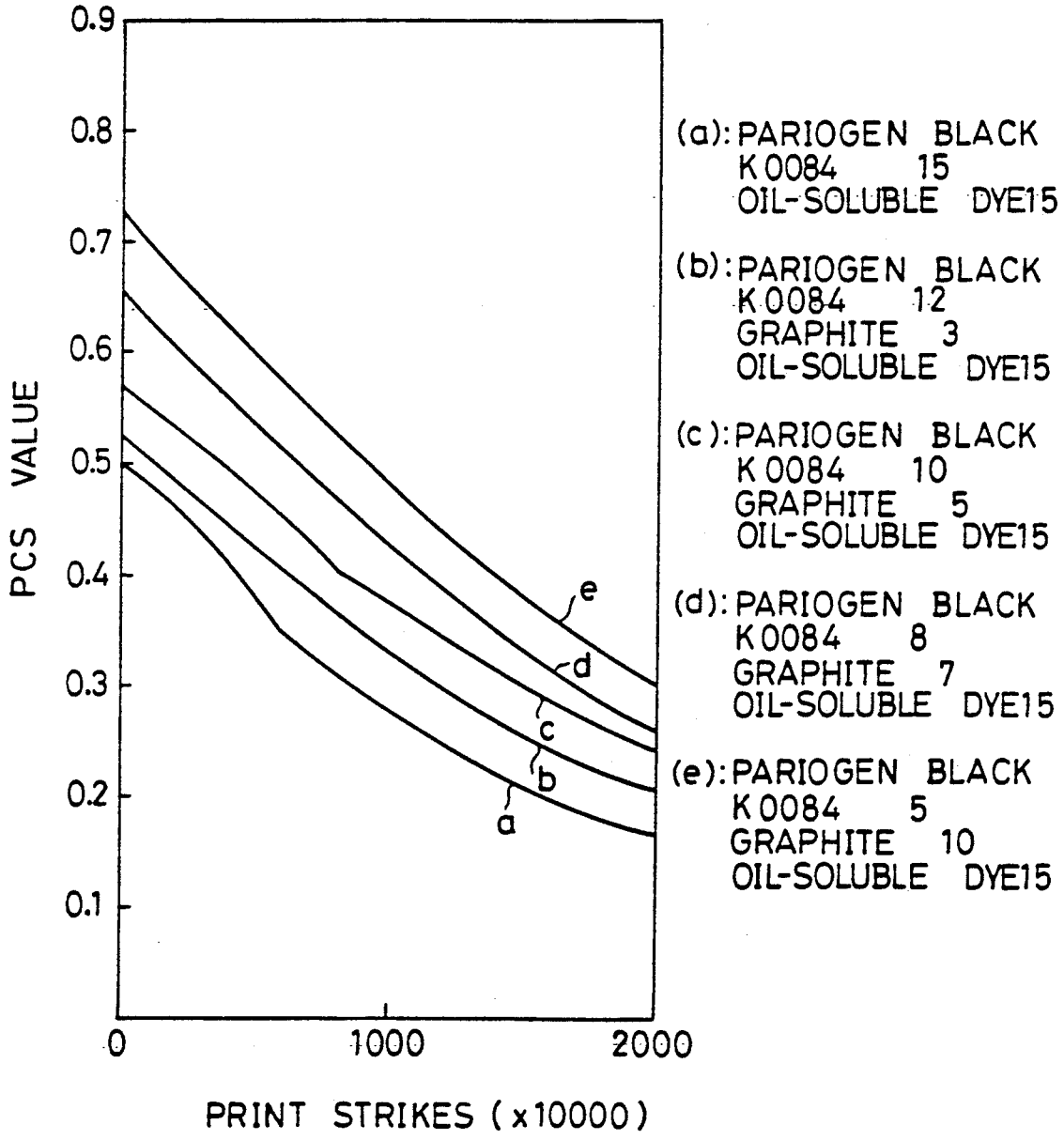
FIG. 5 shows the relation between number of print strikes and PCS (Print Contrast Signal) value.

As shown by curve a in FIG. 5, the PCS value was 0.3 at approximately 8 million strikes.

Figure 6:
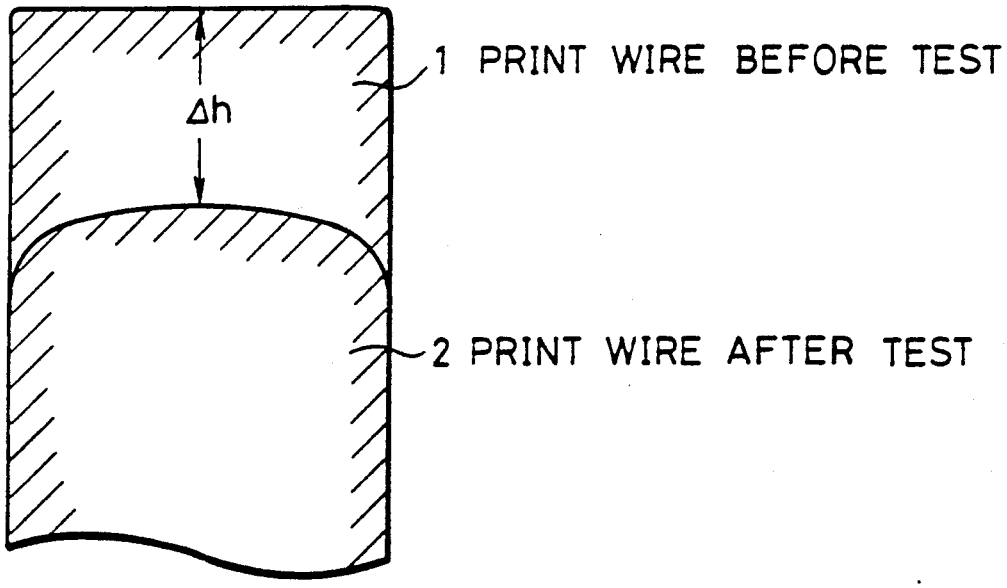
FIGS. 6–9 are schematic diagrams of the tip of the print wire.
Figure 7:
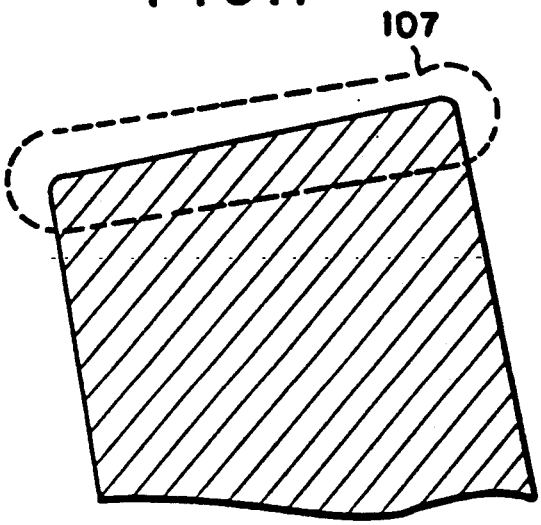

Wear of the print wires was investigated, as shown in FIG. 6, by measuring the decrease of length $\Delta h$ in micron units along the center axes of print wires 1, 2 before and after the test ($\Delta h$ will be referred to as the wear depth in the axial direction of the print wires). Further, variations in tip shape of the print wires were observed with an electron microscope. It was found that after 100 million strikes, the wear depth in the axial direction was 7 $\mu m$). As seen in FIG. 7, there was no macroscopic change of tip shape having a substantially planar surface 107, and no missing print pixels.

EMBODIMENT B1

An ink was prepared as in Comparative Example B1 by mixing 30 parts of vegetable oil, 30 parts of mineral oil, 12 parts of Pariogen Black K0084, 15 parts of oil-soluble dye, 3 parts of graphite with an average particle diameter of 5.0 $\mu m$, and 10 parts of sorbitan fatty acid ester. An ink ribbon was manufactured from this ink. The ribbon was then loaded into a printer, and the printer was operated to carry out a similar test to that of Comparative Example B1. As shown by curve b in FIG. 5, the PCS value was 0.3 at approximately 12 million strikes which is therefore the life of the ribbon.

Further, after 100 million strikes, the wear depth was 8 $\mu m$, and there was no macroscopic change of tip shape or missing print pixels.

EMBODIMENT B2

An ink was prepared by mixing 30 parts of vegetable oil, 30 parts of mineral oil, 10 parts of Pariogen Black K0084, 15 parts of oil-soluble dye, 5 parts of graphite with an average particle diameter of 5.0 $\mu m$, and 10 parts of sorbitan fatty acid ester. An ink ribbon was manufactured from this ink. The ribbon was then loaded into a printer, and the printer was operated to carry out a similar test to that of Embodiment B1. As shown by curve c in FIG. 5, the PCS value was 0.3 at approximately 15 million strikes which is therefore the life of the ribbon.

After 100 million strikes, the wear depth was 8 $\mu m$, there was no macroscopic change of tip shape, and there was no deterioration of print quality with regard to clarity or hue. Further, there was no variation in the fluidity of the ink.

EMBODIMENT B3

An ink was prepared by mixing 30 parts of vegetable oil, 30 parts of mineral oil, 8 parts of Pariogen Black K0084, 15 parts of oil-soluble dye, 7 parts of graphite with an average particle diameter of 5.0 $\mu m$, and 10 parts of sorbitan fatty acid ester. An ink ribbon was manufactured from this ink. The ribbon was then loaded into a printer, and the printer was operated to carry out a similar test to that in Embodiment B1;

As shown by curve d in FIG. 5, the PCS value was 0.3 at approximately 17 million strikes which is therefore the life of the ribbon.

After 100 million strikes, the wear depth was 7 $\mu m$, there was no macroscopic change of tip shape, and there was no deterioration of print quality with regard to clarity or hue. Further, the fluidity of the ink was satisfactory.

EMBODIMENT B4

An ink was prepared with addition of 5 parts of Pariogen Black K0084 and 10 parts of graphite with an average particle diameter of 5 $\mu m$, the other constituents being the same as in Embodiment B3. As shown by curve e in FIG. 5, the PCS value was 0.3 at approximately 20 million strikes which is therefore the life of the ribbon.

After 100 million strikes, the wear depth was 7 $\mu m$, there was no macroscopic change of tip shape, and there was no deterioration of print quality with regard to clarity or hue. The fluidity of the ink did vary slightly, but this presented no problem in use.

COMPARATIVE EXAMPLE B2

An ink was prepared with addition of 3 parts of Pariogen Black K0084 and 12 parts of graphite with an average particle diameter of 5 $\mu m$, the other constituents being the same as in Embodiment B3. In this case, the fluidity of the ink was poor, and it was found impossible to coat and impregnate the ink ribbon substrate uniformly.

Figure 4:
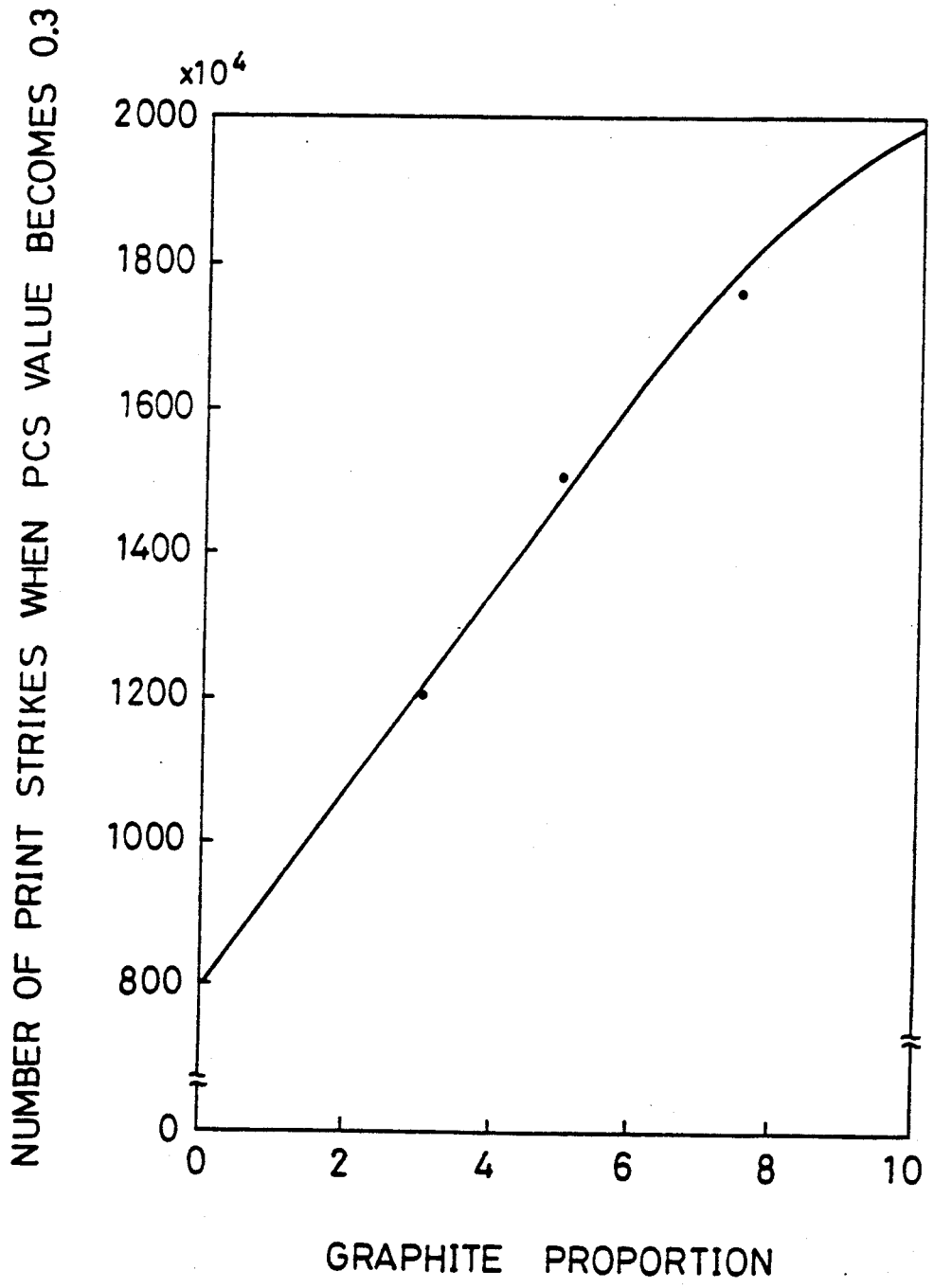
FIG. 4 shows the relation between graphite proportion and number of print strikes.

FIG. 4 shows the number of print strikes at which the PCS value was 0.3 on the vertical axis against graphite concentration on the horizontal axis based on the foregoing results. From this figure, it is seen that the life of the ribbon increases with graphite concentration, and is approximately doubled with the addition of 5 parts graphite. At 10 parts graphite, the life is increased by approximately 2.5 times. Above 10 parts, however, the fluidity of the ink was poor, and it was impossible to coat and impregnate the ribbon substrate uniformly.

Further, when the same tests were carried out with graphite of average particle size 1.0 μm, 3.0 μm or 7.0 μm instead of 5.0 μm as above, almost identical results were obtained.

COMPARATIVE EXAMPLE B3

An ink ribbon was prepared with addition of 30 parts vegetable oil, 30 parts mineral oil, 12 parts Pariogen Black K0084, 15 parts oil-soluble dye, 3 parts carbon black and 10 parts sorbitan fatty acid ester, the remaining procedure being the same as in Embodiment B1. The ribbon was loaded into a printer, and the printer was operated. The PCS value was 0.3 at approximately 12 million strikes which is therefore the life of the ribbon.

Figure 8:
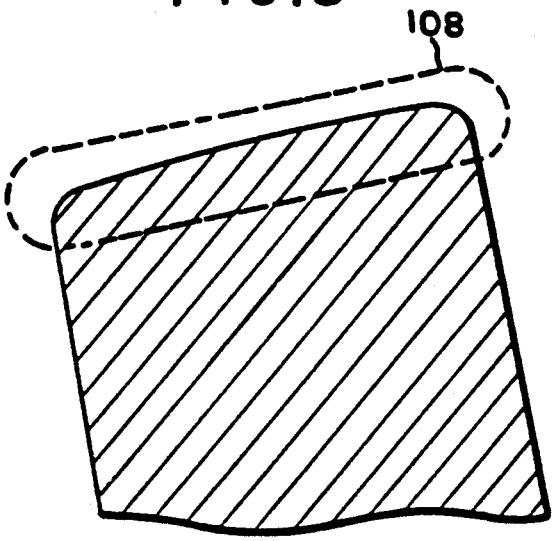

After 100 millions strikes, the wear depth in the axial direction reached 29 μm. Further, as shown in FIG. 8, a slightly curved surface 108 was observed in the tip portion, but no missing print pixels were found.

COMPARATIVE EXAMPLE B4

An ink ribbon was prepared with addition of 10 parts Pariogen Black K0084 and 5 parts carbon black, the remaining procedure being the same as in Embodiment B3. After test, the PCS value was 0.3 at 16 million strikes which is therefore the life of the ribbon.

Figure 9:
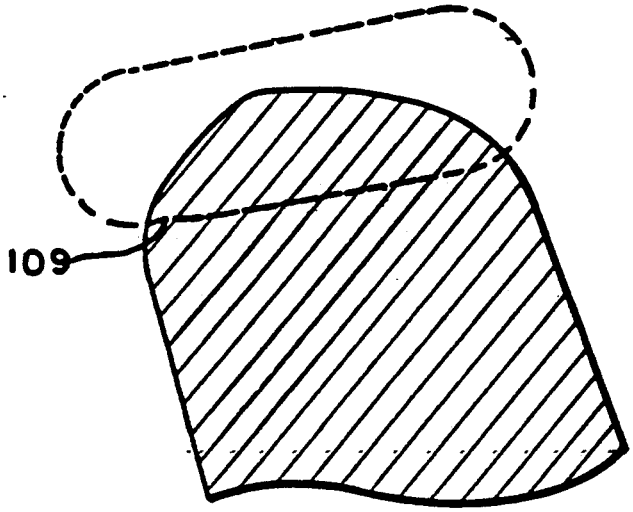

After 100 million strikes, the wear depth reached 86 μm. Further, the tip presented a tapered surface 109 as shown in FIG. 9. On several occasions, the ink ribbon was damaged and several wires broke when they caught on the ribbon.

COMPARATIVE EXAMPLE B5

An ink ribbon was prepared with addition of 5 parts Pariogen Black K0084 and 10 parts carbon black, the remaining procedure being the same as in Embodiment B3. The PCS value was 0.3 at 19 million strikes which is therefore the life of the ribbon.

After 100 million strikes, the wear depth reached 145 μm. Further, the tip was tapered and on several occasions, the ink ribbon was damaged.

In the above embodiments, when other organic pigments were used instead of Pariogen Black K0084, such as condensed polycyclic dyes, azo dyes, phthalocyanine dyes and lake, similar results were obtained.

TABLE 2

| | Ink Composition (Units are Parts by Weight) | | | | | | Number of Print Strikes at which PCS Value is 0.3 | Wear Depth (μm) | Tip Shape | Print Quality |
|---|---|---|---|---|---|---|---|---|---|---|
| | Carrier | | Coloring Material | | Dispersion Agent | | | | | |
| Comparative Example | | | | | | | | | | |
| 1 | Vegetable Oil<br>Mineral Oil | 30<br>30 | Pariogen Black K0084<br>Oil-soluble Dye | 15<br>15 | Sorbitan Fatty Acid Ester | 10 | $800 \times 10^4$ | 7 | No Change | Good |
| Embodiment | | | | | | | | | | |
| 1 | Vegetable Oil<br>Mineral Oil | 30<br>30 | Pariogen Black K0084<br>Graphite<br>Oil-soluble Dye | 12<br>3<br>15 | Sorbitan Fatty Acid Ester | 10 | $1200 \times 10^4$ | 8 | No Change | " |
| 2 | Vegetable Oil<br>Mineral Oil | 30<br>30 | Pariogen Black K0084<br>Graphite<br>Oil-soluble Dye | 10<br>5<br>15 | Sorbitan Fatty Acid Ester | 10 | $1500 \times 10^4$ | 8 | No Change | " |
| 3 | Vegetable Oil<br>Mineral Oil | 30<br>30 | Pariogen Black K0084<br>Graphite<br>Oil-soluble Dye | 8<br>7<br>15 | Sorbitan Fatty Acid Ester | 10 | $1700 \times 10^4$ | 7 | No Change | " |
| 4 | Vegetable Oil<br>Mineral Oil | 30<br>30 | Pariogen Black K0084<br>Graphite<br>Oil-soluble Dye | 5<br>10<br>15 | Sorbitan Fatty Acid Ester | 10 | $2000 \times 10^4$ | 7 | No Change | " |
| Comparative Example | | | | | | | | | | |
| 2 | Vegetable Oil<br>Mineral Oil | 30<br>30 | Pariogen Black K0084<br>Graphite<br>Oil-soluble Dye | 3<br>12<br>15 | Sorbitan Fatty Acid Ester | 10 | — | — | — | — |
| 3 | Vegetable Oil<br>Mineral Oil | 30<br>30 | Pariogen Black K0084<br>Graphite<br>Oil-soluble Dye | 12<br>3<br>15 | Sorbitan Fatty Acid Ester | 10 | $1200 \times 10^4$ | 29 | Slightly Altered | Good |
| 4 | Vegetable Oil<br>Mineral Oil | 30<br>30 | Pariogen Black K0084<br>Graphite<br>Oil-soluble Dye | 10<br>5<br>15 | Sorbitan Fatty Acid Ester | 10 | $1600 \times 10^4$ | 86 | Tapered | Poor |
| 5 | Vegetable Oil<br>Mineral Oil | 30<br>30 | Pariogen Black K0084<br>Graphite<br>Oil-soluble Dye | 5<br>10<br>15 | Sorbitan Fatty Acid Ester | 10 | $1900 \times 10^4$ | 145 | " | " |

As described above, according to the embodiments B1 to B4 described above, the admixture of 5–10 parts by weight concentration of graphite with ribbon inks containing organic pigments, greatly reduces wear in impact printers with ferrous wire high speed print heads and greatly improves print density properties in the near infra-red wavelength region. There are consequently far less errors when reading print with OCR devices which are used to input information to computers, etc., and stable input can thus be achieved. Further, the lifetime of the ribbon is greatly extended.

It will of course be understood that this invention will give the above results not only in dot impact printers, but also in other types of impact printers such as daisy wheel printers.

What is claimed is:

1. An ink ribbon for a printer comprising a ribbon substrate and an ink containing an organic pigment as coloring material, said ink containing 5.0–10.0 parts by weight of graphite per 100 parts by weight of ink.

2. An ink ribbon as in claim 1, wherein said graphite is in the form of particles having an average diameter of about 5 μm.

* * * * *